US008567524B2

(12) United States Patent
Schimanski et al.

(10) Patent No.: US 8,567,524 B2
(45) Date of Patent: Oct. 29, 2013

(54) DOWNHOLE APPARATUS WITH A WIRELESS DATA COMMUNICATION DEVICE BETWEEN ROTATING AND NON-ROTATING MEMBERS

(75) Inventors: Michell Schimanski, Niedersachsen (DE); Michael Koppe, Niedersachsen (DE); Olof Hummes, North-Rhine-Westphalia (DE)

(73) Assignee: Baker Hughes Incorporated, Houston, TX (US)

( * ) Notice: Subject to any disclaimer, the term of this patent is extended or adjusted under 35 U.S.C. 154(b) by 427 days.

(21) Appl. No.: 12/701,665

(22) Filed: Feb. 8, 2010

(65) Prior Publication Data

US 2010/0200295 A1 Aug. 12, 2010

Related U.S. Application Data

(60) Provisional application No. 61/151,058, filed on Feb. 9, 2009.

(51) Int. Cl.
*E21B 47/12* (2012.01)

(52) U.S. Cl.
USPC ..... 175/40; 175/45; 175/76

(58) Field of Classification Search
USPC ..... 175/40, 45, 76
See application file for complete search history.

(56) References Cited

U.S. PATENT DOCUMENTS

| | | | | |
|---|---|---|---|---|
| 4,285,236 | A * | 8/1981 | Chien | 73/152.49 |
| 5,957,221 | A | 9/1999 | Hay et al. | |
| 6,149,295 | A * | 11/2000 | Volkmer et al. | 366/142 |
| 6,446,736 | B1 | 9/2002 | Kruspe et al. | |
| 6,540,032 | B1 * | 4/2003 | Krueger | 175/40 |
| 6,739,409 | B2 | 5/2004 | Kruspe et al. | |
| 6,913,095 | B2 | 7/2005 | Krueger | |
| 7,083,006 | B2 | 8/2006 | Kruspe et al. | |
| 8,102,276 | B2 * | 1/2012 | Sugiura | 340/854.8 |
| 2001/0042643 | A1 | 11/2001 | Krueger et al. | |
| 2006/0124354 | A1 * | 6/2006 | Witte | 175/40 |
| 2008/0094222 | A1 * | 4/2008 | Kaoru | 340/572.7 |
| 2009/0151934 | A1 * | 6/2009 | Heidecke et al. | 166/250.01 |

FOREIGN PATENT DOCUMENTS

| | | | |
|---|---|---|---|
| WO | WO0028188 | | 5/2000 |
| WO | WO0127435 | A1 | 4/2001 |
| WO | WO01/51761 | A1 | 7/2001 |
| WO | WO2009032163 | A1 | 3/2009 |

OTHER PUBLICATIONS

Canadian Office Action dated Dec. 19, 2012 for Canadian Application No. 2,751,718.

* cited by examiner

*Primary Examiner* — Giovanna Wright
(74) *Attorney, Agent, or Firm* — Cantor Colburn LLP

(57) ABSTRACT

A drilling assembly is disclosed that in one embodiment includes a bi-directional wireless data transfer device between a rotating and a non-rotating member of the drilling assembly. Power may be supplied to the rotating member via any suitable method, including an inductive device and direct electrical connections.

18 Claims, 3 Drawing Sheets

DOWNHOLE APPARATUS WITH A WIRELESS DATA COMMUNICATION DEVICE BETWEEN ROTATING AND NON-ROTATING MEMBERS

CROSS-REFERENCE TO RELATED APPLICATIONS

This patent application claims priority from U.S. Provisional Patent Application Ser. No. 61/151,058 filed on Feb. 9, 2009.

BACKGROUND INFORMATION

1. Field of the Disclosure

This disclosure relates generally to data communication between rotating and non-rotating members of downhole tools used for drilling wellbores.

2. Background of the Art

Oil wells (also referred to as "wellbores" or "boreholes") are drilled with a drill string that includes a tubular member having a drilling assembly (also referred to as the "bottomhole assembly" or "BHA") attached to its bottom end. Drilling assemblies typically include devices and sensors that provide information about a variety of parameters relating to the drilling operations ("drilling parameters"), behavior of the drilling assembly ("drilling assembly parameters" or "BHA parameters") and the formation surrounding the wellbore ("formation parameters"). A drill bit attached to the bottom end of the drilling assembly is rotated by rotating the drill string and/or by a drilling motor (also referred to as a "mud motor") in the BHA to disintegrate the rock formation to drill the wellbore. A large number of wellbores are drilled along contoured trajectories. For example, a single wellbore may include one or more vertical sections, deviated sections and horizontal sections through differing types of rock formations. Some drilling assemblies include a non-rotating or substantially non-rotating sleeve outside a rotating drill collar. A number of force application members on the sleeve are extended to apply selective force inside the wellbore to alter the drilling direction to drill the wellbore along a desired well path or trajectory. The non-rotating sleeve includes electrical and electronics components, such as motors, sensors and electronics circuits for processing of data. U.S. Pat. No. 6,540,032, issued to the assignee of this application, which is incorporated herein by reference in its entirety, discloses an exemplary drilling assembly in which both power and data between the rotating and non-rotating members are transmitted via an inductive coupling device, such as an inductive transformer, wherein the data signals are modulated onto the power signals. Such a method, in some aspects, may be limited in bandwidth. The data signals also may be corrupted by the noise generated by the inductive transformer. Therefore, there is a need for an improved data communication apparatus and method for transferring data signals between rotating and non-rotating members of downhole tools.

SUMMARY

The disclosure herein, in one aspect, provides an apparatus for use in a wellbore, which apparatus in one configuration may include a rotating member and a non-rotating member with a gap therebetween, and a device configured to provide wireless data communication between the rotating member and the non-rotating member during drilling of the wellbore.

In another aspect a method of drilling a wellbore is disclosed that in one aspect may include: conveying a drilling assembly into a wellbore, the drilling assembly including a rotating member and an associated non-rotating member; performing a drilling operation; and wirelessly transmitting data signals between the rotating member and the non-rotating member relating to a drilling operation during drilling of the wellbore.

Examples of certain features of apparatus and method for wirelessly transferring data signals between rotating and non-rotating members of a downhole tool are summarized rather broadly in order that the detailed description thereof that follows may be better understood. There are, of course, additional features of the apparatus and method disclosed hereinafter that will form the subject of the claims made pursuant to this disclosure.

BRIEF DESCRIPTION OF THE DRAWINGS

The disclosure herein is best understood with reference to the accompanying figures in which like numerals have generally been assigned to like elements and in which.

DETAILED DESCRIPTION OF THE EMBODIMENTS

Figure 1:
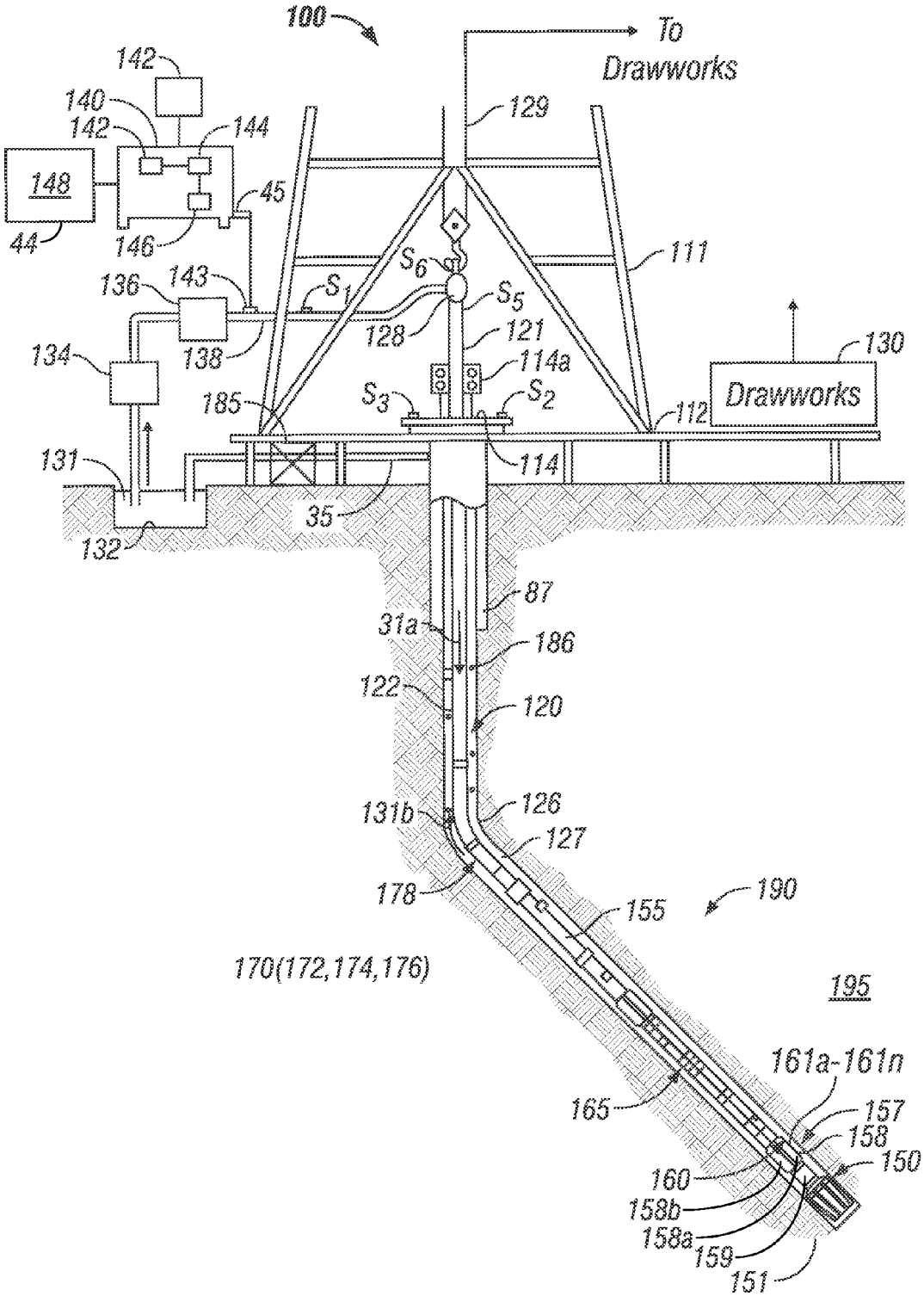
FIG. 1 is a schematic diagram of an exemplary drilling system that includes a drill string with a drilling assembly attached to its bottom end that further includes a bi-directional data communication system between a rotating member and a non-rotating member, according to one embodiment of the disclosure.

FIG. 1 is a schematic diagram of an exemplary drilling system 100 that includes a drill string with a drilling assembly attached to its bottom end that includes a wireless bi-directional data communication system between a rotating member and a non-rotating or a substantially non-rotating member, according to one embodiment of the disclosure. FIG. 1 shows a drill string 120 that includes a bottomhole assembly (BHA) or drilling assembly 190 conveyed in a borehole 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe) 122 having the drilling assembly 190 attached at its bottom end extends from the surface to the bottom 151 of the borehole 126. A drill bit 150, attached to drilling assembly 190, disintegrates the geological formations when it is rotated to drill the borehole 26. The drill string 120 is coupled to a drawworks 130 via a Kelly joint 121, swivel 128 and line 129 through a pulley. Drawworks 130 is operated to control the weight on bit ("WOB"). The drill string 120 may be rotated by a top drive (not shown) instead of by the prime mover and the rotary table 114. Alternatively, a coiled-tubing may be used as the tubing 122. A tubing injector 114*a* may be used to convey the coiled-tubing having the drilling assembly attached to its bottom end. The operations of the drawworks 130 and the tubing injector 14*a* are known in the art and are thus not described in detail herein.

A suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131 discharges at the borehole bottom 151 through openings in the drill bit 150. The drilling fluid 131 circulates uphole through the annular space 127 between the drill string 120 and the borehole 126 and returns to the mud pit 132 via a return line 135 and drill cutting screen 185 that removes the drill cuttings 186 from the returning drilling fluid 131*b*. A sensor $S_1$ in line 138 provides information about the fluid flow rate. A surface torque sensor $S_2$ and a sensor $S_3$ associated with the drill string 120 respectively provide information about the torque and the rotational speed of the drill string 120. Tubing injection speed is determined from the sensor $S_5$, while the sensor $S_6$ provides the hook load of the drill string 20.

In some applications, the drill bit 150 is rotated by only rotating the drill pipe 122. However, in many other applications, a downhole motor 155 (mud motor) is disposed in the drilling assembly 190 to also rotate the drill bit 150. The ROP for a given BHA largely depends on the WOB or the thrust force on the drill bit 150 and its rotational speed.

The mud motor 155 is coupled to the drill bit 150 via a drive disposed in a bearing assembly 157. The mud motor 155 rotates the drill bit 150 when the drilling fluid 131 passes through the mud motor 155 under pressure. The bearing assembly 157, in one aspect, supports the radial and axial forces of the drill bit 150, the down-thrust of the mud motor 155 and the reactive upward loading from the applied weight-on-bit.

A surface control unit or controller 140 receives signals from the downhole sensors and devices via a sensor 143 placed in the fluid line 138 and signals from sensors $S_1$-$S_6$ and other sensors used in the system 100 and processes such signals according to programmed instructions provided to the surface control unit 140. The surface control unit 140 displays desired drilling parameters and other information on a display/monitor 142 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole, and may control one or more operations of the downhole and surface devices.

The BHA 300 may also contain formation evaluation sensors or devices (also referred to as measurement-while-drilling ("MWD") or logging-while-drilling ("LWD") sensors) determining resistivity, density, porosity, permeability, acoustic properties, nuclear-magnetic resonance properties, properties or characteristics of the fluids downhole and other desired properties of the formation 195 surrounding the drilling assembly 190. Such sensors are generally known in the art and for convenience are generally denoted herein by numeral 165. The drilling assembly 190 may further include a variety of other sensors and devices 159 for determining one or more properties of the BHA (such as vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc.) For convenience, all such sensors are denoted by numeral 159.

The drilling assembly 190, in one configuration, may include a steering device 158 that in one aspect may include a non-rotating member or a substantially non-rotating sleeve 158*b* around a rotating member (shaft) 158*a*. During drilling, the sleeve the sleeve 158*b* may not be completely stationary, but rotate at a very low rotational speed. In aspects, a relative speed between the non-rotating sleeve 158*b* and rotating member 158*a* may be measured and maintained within a selected range by the disclosed system and method. Typically, the drill shaft rotates between 100 and 600 revolutions per minute (rpm) while the sleeve may rotate at less than 2 rpm. Thus, the sleeve 158*b* is substantially non-rotating. In one aspect, the non-rotating sleeve may include a number of force application members (also referred to herein as "ribs"), each of which may be extended from the non-rotating member 158*a* to exert force on the wellbore inside. Each such rib may be independently controlled as described in reference to FIG. 2.

Still referring to FIG. 1, the drilling assembly includes a wireless data communication device 160 configured to provide bi-directional data communication between the rotating member 158*a* and non-rotating member 158*b*. A power source 178 may be provided in the drill string 180 to generate electrical power for use by the drilling assembly 190. The power source 178 may be any suitable device, including, but not limited to, a turbine operated by the drilling fluid 131 flowing through the drilling assembly 190 that drives an alternator (not shown). The power from the power source 178 may also be supplied to the electrical devices and circuits in the non-rotating member 158*b* via a direct connection, such as slip rings or via an inductive coupling device as described in reference to FIG. 3. The drilling assembly 190 may further include a controller 170, which may further include a processor 172, such a microprocessor, a data storage device (or a computer-readable medium) 174 for storing therein data, algorithms and computer programs 176. The data storage device 174 may be any suitable device, including, but not limited to a read-only memory (ROM), random-access memory (RAM), flash memory and hard disk.

During drilling operations, the controller 170 may control the operation of one or more devices and sensors in the drilling assembly 190, including the operation of force application members or ribs 161*a*-161*n* of a steering unit on the non-rotating member 158*b* and receive data from the sensors 165 and 159 in the drilling assembly 190, in accordance with the instructions provided by the programs 176 and/or instructions sent from the surface by the controller 140. The various aspects of the bi-directional data communication unit 160 for transferring data between a rotating member and non-rotating member are described in more detail in reference to FIGS. 2 and 3.

Figure 2:
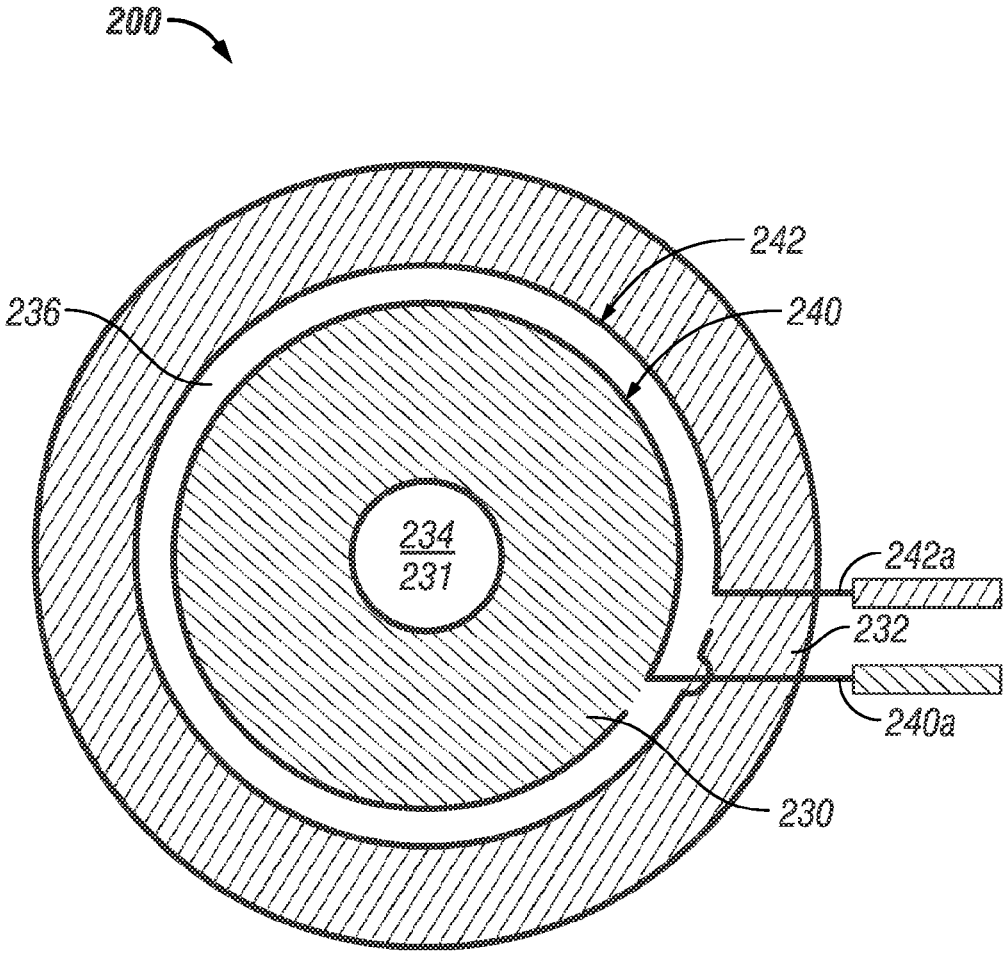
FIG. 2 is schematic diagram of a cross-section of a rotating member inside a non-rotating member of a drilling assembly with aligned concentric antennas that may be utilized for transmitting and receiving wireless data signals, according to one embodiment of the disclosure.

FIG. 2 is schematic diagram 200 of a cross-section of a rotating member 230 inside a non-rotating member 232 of a drilling assembly with concentric or substantially concentric loop antennas configured to wirelessly transfer data between the rotating and non-rotating members, according to one embodiment of the disclosure. The rotating member 230 is shown to include a bore 234 through which a drilling fluid 231 may pass. A gap 236 allows the drilling fluid 231, such as drilling fluid, to flow between the rotating member 230 and non-rotating member 232. A loop antenna 240 (first antenna) is placed around the periphery of the rotating member 230 which terminates in a wire connection 240*a*. Another loop antenna 242 (second antenna) is placed around the non-rotating member 232 which terminates in a wire connection 242*a*. In one aspect, the antennas 240 and 242 are aligned or substantially aligned across from each other for efficient transfer of data signals between the two antennas. In FIG. 2, the antennas are shown to form a pair of concentric rings. Aligning antennas also improves bandwidth and noise immunity. Any other suitable antenna design, configuration and placement may be utilized for the purpose of this disclosure. In one aspect, the gap 236 between the antennas may be relatively small. The placement of the antennas 240 and 242 along with their respective operations are described in more detail in reference to FIG. 3.

Figure 3:
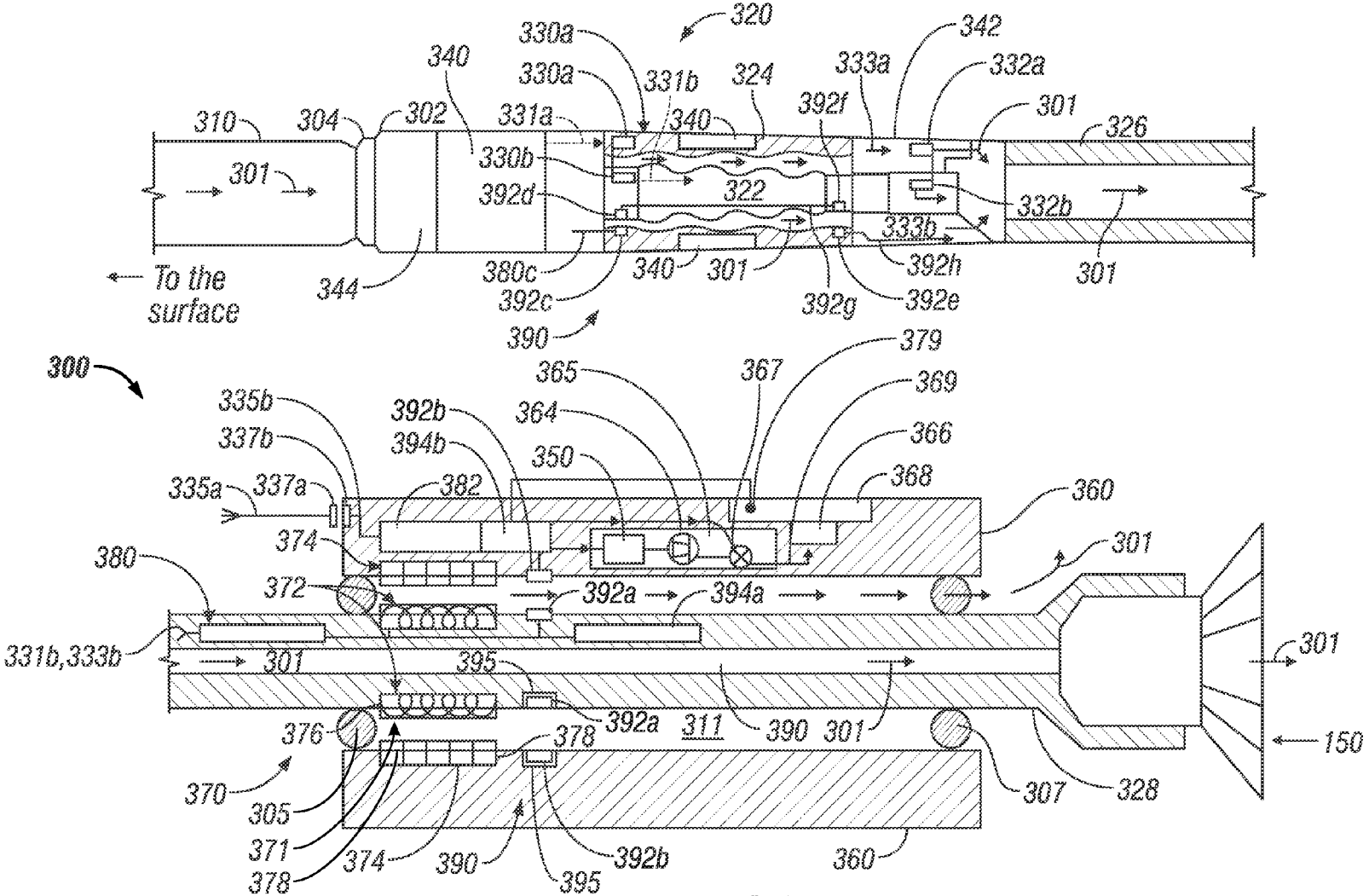
FIG. 3 is a schematic diagram of a drilling assembly showing various exemplary functional elements or devices associated with a typical drilling assembly and a data transfer device configured to wirelessly transfer data signals between rotating and non-rotating members of the drilling assembly, according to one embodiment of the disclosure.

FIG. 3 is a schematic illustration of an exemplary drilling assembly 300 showing a data transfer device 390 for wirelessly transferring data between a rotating member and a non-rotating member. The drilling assembly 300 is shown coupled at its top end or uphole end 302 to a tubing 310 via a coupling device 304. The tubing 310, which, as noted earlier, is usually a jointed pipe or a coiled-tubing, along with the drilling assembly 300, is conveyed from a surface location into the wellbore being drilled. The drilling assembly 300 includes a mud motor power section 320 that has a rotor 322 inside a stator 324. Drilling fluid 301 supplied under pressure to the tubing 310 passes through the mud motor power section 320, which rotates the rotor 322. The rotor 322 drives a flexible coupling shaft 326, which in turn rotates the drive shaft 328 that rotates the drill bit 150. A variety of measurement-while-drilling sensors or logging-while-drilling sensors, generally referenced herein by numeral 340, carried by the drilling assembly 300, provide measurements for various parameters, including borehole parameters, formation evaluation parameters, and drilling assembly parameters. The sensors 340 may be distributed in one or more sections of the drilling assembly 300.

In one aspect, electric power may be generated by a turbine-driven alternator 344. The turbine, in one aspect, may be driven by the drilling fluid 301 supplied under pressure from the surface. Electric power also may be supplied from the surface via appropriate conductors or from batteries in the drilling assembly 300. In the exemplary drilling assembly 300 shown in FIG. 3, the drive shaft 328 that rotates the drill bit 150 is shown as the rotating member and a sleeve 360 around the shaft 328 is shown as the non-rotating member. An electrical power transfer device 370 associated with the rotating member 328 and the non-rotating member 360 transfers electric power from the rotating member 328 to the non-rotating member 360. In one aspect, the electric power transfer device 370 may include an inductive coupling device, such as an inductive transformer, having a transmitter section 372 on the rotating member 328 and a receiver section 374 on the non-rotating member 360 across from the transmitter section 372. The transmitter section 372 and receiver section 374 respectively contain coils 376 and 378. In another aspect, power may be transferred using a pair of aligned or substantially aligned antennas or slip rings (not shown). Electric power to the coils 376 (or equivalently to the loop antenna or slip ring 397*a*) is supplied by a primary control circuit 380 (also referred to herein as the "primary electronics"). The primary control circuit 380 generates a suitable A.C. voltage at a selected frequency and supplies it to the coils 376. The A.C. voltage supplied to the coils 376, in one aspect, may be set at a high frequency, e.g. above 500 Hz. A secondary control circuit 382 (also referred to herein as the "secondary electronics") in the non-rotating member 360 converts the A.C. voltage from the receiver 374 to a D.C. voltage, which is utilized to operate various electronic components in the secondary electronics and any electrically-operated devices in the non-rotating member 360. Drilling fluid 301 usually fills the gap 311 between the rotating member 328 and the non-rotating member 360. Bearings 305 and 307 between the rotating member 328 and the non-rotating member 360 provide lateral stabilization.

Still referring to FIG. 3, a wireless data transfer device 390 transfers data wirelessly between the rotating member 328 and the non-rotating member 360. In one aspect, the wireless data transfer device 390 may include an antenna 392*a* on the rotating member 328 and another antenna 392*b* on the non-rotating member 360. A transmitter/receiver circuit 394*a* associated with the antenna 392*a* transmits data signals to the antenna 392*a* for wireless transmission and receives wireless signals from the antenna 392*a* for processing. Similarly, a transmitter/receiver 394*b* associated with the antenna 392*b* receives the wireless data signals transmitted by the antenna transmitter/receiver circuit 394*a* and transmits the data signals to the antenna 392*b*. As described in reference to FIG. 2, the antennas 392*a* and 392*b* may respectively be placed around the non-rotating member 328 and non-rotating member 360 and aligned or substantially aligned with each other across the gap 311. In one aspect, the transmitter/receiver circuit 394*a* may include an oscillator circuit for supplying electrical signals at a desired frequency to the antenna 392*a* in response to instructions received from the controller 170 (FIG. 1). Similarly, circuit 394*a* may process the data signals received by the antenna 392*a* and transmit the processed signals to the controller 170 for further processing. The circuit 394*b* receives signals from one or more sensors 367 in the non-rotating member 360, processes such received signals and provides data signals to the antenna 392*b* for wireless transmission to antenna 392*a*. The circuit 392*b* also may control the operation of one or more devices in the non-rotating member 360. In another aspect, the non-rotating member 360 may be non-rotating relative to another member, such as a side of a drill collar section. In such a configuration, a wireless data transmission device 335 may be utilized to transfer data between the non-rotating member 360 and the drill collar section. The data transfer device may include an antenna 337*a* on the rotating member and an antenna 337*b* on the non-rotating member 360. The circuitry 394*a* may then be located in the rotating member. It should be noted that the rotating member may be inside, outside or on a side of the rotating member. Utilizing separate antennas for data transfer improves band width and noise immunity relative to structures wherein both power and data is transferred using a common inductive coupling.

Still referring to FIG. 3, in one aspect, the non-rotating member 360 may include a number of force application members or ribs 368 for applying force on the wellbore inside for altering the drilling assembly direction during drilling of the wellbore. A motor 350 operated by the secondary electronics 382 drives a pump 364, which supplies a working fluid, such as oil, from a source 365 to a piston 366. The piston 366 moves its associated rib 368 radially outward from the non-rotating member 360 to exert a force on the wellbore inside. The pump speed is controlled or modulated to control the force applied by the rib 368 on the wellbore inside. Alternatively, a fluid flow control valve 367 in a hydraulic line 369 between the pump 364 and the piston 366 may be utilized to control the supply of fluid to the piston 366 and thereby to control the force applied by the rib 368. The secondary electronics 382 also may control the operation of the valve 367. Usually three ribs 368 are carried by the non-rotating member 360, each such rib being independently operated by a pump. The secondary electronics 382 receives signals from sensors 379 carried by the non-rotating member 360. At least one of the sensors 379 provides measurements indicative of the force applied by the rib 368. Each rib has a corresponding sensor. The secondary electronics 382 conditions the sensor signals and may compute values of the corresponding parameters and supply signals indicative of such parameters to the circuitry 394*b*, which transfers such signals to the antenna 392*a*. Frequency and/or amplitude modulation techniques and discrete signal transmitting techniques, known in the art, may be utilized to transfer information between the transmitter and receiver or vice versa. The information from the primary electronics may include command signals for controlling the operation of the devices in the non-rotating sleeve. For the purpose of this disclosure any suitable method or protocol of transferring data may be utilized, including, but not limited to, Bluetooth, Zig Bee, Wireless LAN, DECT, GSM, UWB and UMTS, at any suitable frequency, such as a frequency between 30 kHz to 30 GHz.

Still referring to FIG. 3, electric power and data/signals from sections 344 and 340 may be transferred to the rotating members 322 via an inductive coupling device 330, which includes a transmitter 330*a* placed at a suitable location in the non-rotating section 324 (stator) of the drilling motor 320 and a receiver 330*b* placed in the rotating section 322 (the rotor). The electric power and data/signals are provided to the transmitter 330*a* via suitable conductors or links 331*a* while power and data/signals are transferred between the receiver 330*b* and the primary electronics 380 and other devices in the rotating members via communication links 331*b*. Alternatively, the electric power and data/signal transfer device 332 may be located toward the lower end of the power section. The device 332 includes a transmitter section 332*a* and a receiver section 332*b*. Communication links 333*a* and 333*b* transfer electric power and data/signals between power section 344, the device 332 and the circuit 380. In another aspect, a wireless data transfer device, such as the device described above, maybe be provided to transfer data signals across the mud motor power section 320 rotating and non-rotating members. In one configuration, a first set of antennas 392*c* and 392*d* may respectively be placed on the stator 324 and rotor 322 on a first or upper side of the mud motor power section 320 and a second set comprising antennas 392*e* and 392*f* on the second or lower side of the mud motor power section 320. A suitable data link 392*g*, such as a wire or optical fiber, may be provided to couple the antennas 392*e* and 392*f* in rotor 322. A data link 380*c* may be provided to transmit and receive data signals from the antenna 392*c* and a data link 392*h* to transmit and receive data signals from the antenna 392*e*. The link 380*c* may be coupled to a suitable circuit uphole of the stator 324 and the link 392*h* to a suitable circuit downhole of the stator 324. This configuration allows for a two-way wireless data communication from one side of the motor 320 to the other. Alternatively, the data signals may be provided to antennas 392*d* and 392*f* in the rotor 322 and transferred to the antennas 392*c* and 392*e* via a data link in the stator 324. Similarly, data may be wirelessly transferred between any rotating and non-rotting members of a drilling assembly.

Thus, in one aspect, the disclosure herein provides an apparatus for use in a wellbore, which apparatus in one configuration may include: a rotating member; a non-rotating member associated with the rotating member with a gap between the rotating member and the non-rotating member; and a wireless data communication device associated with the rotating member and the non-rotating member configured to provide wireless data communication between the rotating member and the non-rotating member during drilling of the wellbore. In one aspect, the wireless data communication device may include a first antenna on the rotating member and a second antenna on the non-rotating member configured to establish the bi-directional data communication between the rotating member and the non-rotating member. In another aspect, a transmitter circuit associated with the rotating member (first transmitter) transmits data signals to the first antenna and a transmitter associated with the non-rotating member (second transmitter) sends data signals to the second antenna. A receiver associated with the rotating member (first receiver) receives the wireless data signals sent by the transmitter associated with the second transmitter and a receiver associated with the non-rotating member (second receiver) receives the wireless signals transmitted by the first transmitter. In another aspect, the first antenna may be placed around the rotating member and the second antenna around an inside of the non-rotating member concentric rings aligned with each of the antennas. In yet another aspect, the non-rotating member may include a force application device that further comprises a number of force application members thereon, configured to apply force on the wellbore inside to alter the drilling direction. A suitable sensor on the non-rotating member may provide signals representative of a parameter of interest. The parameter may be one of: force applied to a selected force-application member and an extension of a selected force-application member from the non-rotating member. Power from the rotating member may be provided to the non-rotating member via any suitable device, including, but not limited to, an inductive coupling and a wired connection, with slip rings.

In another aspect, the disclosure provides a method of drilling a wellbore, which may include: conveying a drilling assembly into a wellbore, the drilling assembly including a rotating member and an associated non-rotating member; performing a drilling operation; and wirelessly transmitting data signals between the rotating member and the non-rotating member during drilling of the wellbore. In one aspect, the wireless data may be transmitted between an antenna (first antenna) on the rotating member and an antenna (second antenna) on the non-rotating member. The data may be provided to the antennas by separate transmitters on the rotating and non-rotating members. In another aspect, the method may include aligning the antennas across from each other. In one aspect, aligning the antennas may be accomplished by placing the antennas as concentric rings. In another aspect, the method may further include sending a first signal to the first antenna corresponding to an operation to be performed by a device on the non-rotating member and transmitting a second signal to the second antenna relating to an operation performed by a device on the non-rotating member. The method may further include providing at least one sensor on the non-rotating member configured to provide signals relating to at least one parameter of an operation of a device on the non-rotating member.

The disclosure herein describes particular embodiments of wireless data communication between a rotating member and non-rotating member of an apparatus for use in a wellbore. Such embodiments are not to be construed as limitations to the concepts described herein.

The invention claimed is:

1. An apparatus for use in a wellbore, comprising:

a rotating member;

a non-rotating member around the rotating member with a gap between the rotating member and the non-rotating member;

a wireless data communication device including a first loop antenna on the rotating member and a second loop antenna on the non-rotating member configured to establish a bi-directional data communication between the rotating member and the non-rotating member, the first loop antenna being substantially aligned with the second loop antenna, wherein the bi-directional data communication comprises waves transmitted at a frequency between 30 kilohertz and 30 gigahertz; and an alignment device including a pair of substantially concentric rings configured to maintain relative position between the first loop antenna and the second loop antenna within a selected limit.

2. The apparatus of claim 1, wherein the rotating member and the non-rotating member are substantially aligned.

3. The apparatus of claim 2, wherein the first and second loop antennas form concentric or substantially concentric rings.

4. The apparatus of claim 1, further comprising an electrical circuit configured to transmit data signals to one of the first loop antenna and the second loop antenna during drilling of the wellbore.

5. The apparatus of claim 1, further comprising at least one sensor configured to provide signals relating to a parameter of an operation of a device on the rotating member.

6. The apparatus of claim 5, wherein the parameter is one of: force applied to a selected force application member in a plurality of force application members; and an amount of extension of a selected force application member relative to a reference point.

7. The apparatus of claim 1, further comprising a plurality of force application members on the non-rotating member and a power device configured to supply power to each force application member in the plurality of force application members.

8. The apparatus of claim 1, wherein the first loop antenna is placed on a rotor of a drilling motor and the second loop antenna is placed on a stator surrounding the rotor.

9. The apparatus of claim 1, further comprising an inductive coupling device configured to transfer power between the rotating member and the non-rotating member, the inductive coupling device transferring power separate from the wireless data communication device communicating data.

10. The apparatus of claim 1 further comprising a pair of antennas, separate from the first and second loop antennas, for transferring power between the rotating member and the non-rotating member.

11. A method of drilling a wellbore, comprising:

conveying a drilling assembly into a wellbore, the drilling assembly including a rotating member having a first loop antenna and a non-rotating member having a second loop antenna, the first loop antenna being substantially aligned with the second loop antenna;

wirelessly transmitting data between the first loop antenna and the second loop antenna during drilling a drilling operation, wherein the wireless data transmission comprises waves bi-directionally transmitted at a frequency between 30 kilohertz and 30 gigahertz; and aligning the first loop antenna and the second loop antenna to maintain relative position between the first loop antenna and the second loop antenna within a selected limit.

12. The method of claim 11, wherein the rotating member is on a rotor of a motor and the non-rotating member is on a stator surrounding the rotor.

13. The method of claim 12, further comprising transmitting a first signal to the first loop antenna corresponding to an operation to be performed by a device on the non-rotating member and transmitting a second signal to the second loop antenna relating to the operation performed by the device on the non-rotating member.

14. The method of claim 11, wherein aligning the first loop antenna and the second loop antenna comprises using an alignment device that includes at least two substantially concentric rings.

15. The method of claim 11, further comprising providing at least one sensor on the non-rotating member configured to provide signals relating to at least one parameter of an operation of a device on the rotating member.

16. The method of claim 15, wherein the at least one parameter is one of: force applied to a selected force-application member in a plurality of force-application members; and an amount of an extension of a selected force-application member from the non-rotating member.

17. The method of claim 11, further comprising transferring electric power between the rotating member and the non-rotating member by an induction coupling between the rotating member and the non-rotating member, the induction coupling transferring electric power separate from the wireless data transmission.

18. An apparatus for use in a wellbore, comprising:

a drilling assembly including a rotating member and a non-rotating member around the rotating member with a gap between the rotating member and the non-rotating member configured to allow flow of a wellbore fluid therethrough;

a wireless data communication device including an antenna pair having a first loop antenna on the rotating member and a second loop antenna on the non-rotating member configured to establish a bi-directional data communication between the rotating member and the non-rotating member, the first loop antenna being substantially aligned with the second loop antenna, wherein the bi-directional data communication comprises waves transmitted at a frequency between 30 kilohertz and 30 gigahertz; and an alignment device including a pair of substantially concentric rings configured to maintain relative position between the rotating member and the non-rotating member within a selected limit.

* * * * *